US006446471B1

(12) United States Patent
Kaplancali

(10) Patent No.: US 6,446,471 B1
(45) Date of Patent: Sep. 10, 2002

(54) WHOLLY ELASTIC KNITTED FABRICS AND METHODS OF PRODUCING THE SAME

(76) Inventor: Mehmet Selcuk Kaplancali, Istanbul (TR)

( * ) Notice: Subject to any disclaimer, the term of this patent is extended or adjusted under 35 U.S.C. 154(b) by 7 days.

(21) Appl. No.: 09/690,386

(22) Filed: Oct. 17, 2000

Related U.S. Application Data

(60) Provisional application No. 60/161,177, filed on Oct. 22, 1999.

(51) Int. Cl.[7] ..... D04B 23/16

(52) U.S. Cl. ..... 66/192; 66/195

(58) Field of Search ..... 66/195, 203, 192, 66/196, 204, 214, 207, 172 E; 442/304, 305, 306, 313, 314

(56) References Cited

U.S. PATENT DOCUMENTS

| | | | | | |
|---|---|---|---|---|---|
| 3,590,603 | A | * | 7/1971 | Jackson | 66/147 |
| 3,733,859 | A | * | 5/1973 | Wittmann | 66/193 |
| 3,827,261 | A | * | 8/1974 | Rupprecht | 66/202 |
| 3,981,415 | A | * | 9/1976 | Fowler et al. | 66/202 |
| 4,055,201 | A | * | 10/1977 | Fowler et al. | 66/202 |
| 4,411,142 | A | * | 10/1983 | Regenstein | 66/196 |
| 4,569,212 | A | * | 2/1986 | LaRue | 66/196 |
| 5,029,457 | A | * | 7/1991 | Gajjar | 66/202 |
| 5,297,402 | A | * | 3/1994 | Bergmann | 66/203 |

FOREIGN PATENT DOCUMENTS

| | | | | |
|---|---|---|---|---|
| DE | 52917 | * | 7/1980 | 66/202 |

* cited by examiner

*Primary Examiner*—Danny Worrell
(74) *Attorney, Agent, or Firm*—White & Case LLP

(57) ABSTRACT

The invention is directed to run-free, wholly elastic fabrics. The knitted fabrics of the invention are produced on a warp knitting machine comprising knitting elements including a needle bar and at least two guide bars for stitching in varying proximity to the needle bar. The guide bars are threaded with an elastic yarn. The elastic yarn is knitted together by moving the knitting elements to produce a series of stitches forming the knitted fabric. Advantageously, the method of the invention makes it possible to produce wholly elastic fabrics with high run-resistant properties without knitting the elastic yarn with natural or other synthetic fibers. The invention also relates to wholly elastic warp knitted fabrics comprising an inlaid yarn. The inlay may be an elastomeric or non-elastomeric warp yarn, weft insertion yarn or combination thereof.

29 Claims, 14 Drawing Sheets

WHOLLY ELASTIC KNITTED FABRICS AND METHODS OF PRODUCING THE SAME

This application claims priority to U.S. provisional patent application having the application Ser. No. 60/161,177, filed Oct. 22, 1999.

BACKGROUND OF THE INVENTION

1. Field of the Invention

The invention relates to run-free, wholly elastic fabrics and methods of making the same. In particular, the invention is directed to elastic textile fabrics that are produced by knitting only elastic yarns together to obtain a run-free, wholly elastic fabric. Advantageously, the method of the invention makes it possible to obtain run-free, wholly elastic fabrics without the need to knit the elastic yarn with natural or other synthetic fibers. The invention also relates to wholly elastic warp knitted fabrics comprising an inlaid yarn. The inlay may be an elastomeric or non-elastomeric warp yarn, weft insertion yarn or combination thereof.

2. Description of the Prior Art

At the time the invention was made, it was not known how to produce a wholly elastic textile fabric of any construction that would not run. The state of the art was such that Lycra® spandex (DuPont) was never used alone, but combined with natural and manmade fibers in all fabric constructions. Therefore, in order to manufacture a warp knitted elastic fabric with acceptable non-run characteristics, it was necessary prior to the invention to knit the elastic yarn with a natural or other synthetic yarn. Alternatively, various elastic warp knitted fabrics are known wherein non-elastic yarn is formed into a fabric or a mesh to bind and hold inlaid elastic threads within the structure.

Prior art patents disclosing warp knitted elastic fabrics include U.S. Pat. Nos. 3,931,721 (Adamson), 4, 107,956 (Parsons), 4,688,403 (Gajjar) and 5,832,749 (Anonietti). U.S. Pat. No. 3,931,721 describes a warp knitted elastic fabric composed of alternating non-elastic courses formed from non-elastic yarns and interweaving elastic courses formed primarily with elastic thread. There is no disclosure or suggestion that the method of U.S. Pat. No. 3,931,721 could be used to knit elastic yarns to prepare run-free, wholly elastic warp knitted fabrics. Intervening non-elastic courses are an integral part of the knitted fabric structure of the U.S. Pat. No. 3,931,721.

U.S. Pat. No. 4,107,956 is directed to a method for warp knitting a narrow clasp fastener carrier tape not exceeding four inches in fill and finished width. A three guide bar construction is employed in which the front guide bar knits a pillar stitch and the middle guide bar performs a two needle overlap in successive courses. The back guide bar lays-in over three or more needles. It is disclosed that the method of U.S. Pat. No. 4,107,956 may be practiced with nylon yarns and blends thereof derived from other synthetic polymers, e.g., polyacrylics, polyesters and materials such as glass. However, there is no disclosure or suggestion that it would be feasible to use elastomeric yarns to warp knit an elastic fabric that is run-free.

U.S. Pat. No. 4,688,403 discloses a method of knitting fabrics with elastomeric and non-elastomeric threads that have surface interest. A single needle bar is fed from a front or first bar of non-elastomeric knitting yarns, e.g., nylon yarn, and a plurality of back bars of elastomeric knitting yarns, e.g., spandex yarn. U.S. Pat. No. 5,832,749 describes a method of making an elastic knitwear fabric by weaving a first thread with elastic or elastomeric characteristics, e.g., Lycra® thread, with a second thread with non-elastic characteristics, e.g., nylon 6. The non-run quality of the fabric is said to be due to the fact that the elastic thread and the non-elastic thread work in opposition during knitting. However, each of U.S. Pat. Nos. 4,688,409 and 5,832,749 lack any meaningful suggestion of knitting elastomeric yarns to produce run-free, wholly elastic warp knit fabrics.

Notwithstanding the many prior art examples of elastic warp knitted fabrics comprised of a plurality of elastic and non-elastic threads, there remains a need to produce a wholly elastic warp knitted fabric with high non-run characteristics.

SUMMARY OF THE INVENTION

For purposes of describing the present invention, the expression "elastic yarn" shall be understood to mean the types of elastic fibers or yarns that are generically known as spandex in the United States and Canada and as elastane in Europe. The term "spandex" has its usual definition, i.e., a long chain synthetic polymer that comprises at least 85% by weight segmented polyurethane. An example of a commercial brand of an elastic yarn that can be used in the invention is sold by DuPont under its Lycra® trademark. Thus, the expression "elastic yarn" as used herein shall include elastic or elastomeric fibers and yarns having the composition and properties that are typical of spandex- and elastane-type fibers. By definition, such "elastic yarn" shall exclude more than traces of other than elastic or elastomeric fibers or filaments. It follows, therefore, that the expression "wholly elastic" when used to describe embodiments of the invention shall mean "elastic yarn" alone.

According to one embodiment of the present invention, a wholly elastic warp knitted fabric is produced on a warp knitting machine comprising knitting elements including a needle bar and at least two guide bars for stitching in varying proximity to the needle bar. To be discussed in connection with other embodiments of the invention, the warp knitting machine may be further comprised of one or more inlay bars and weft insertion devices. However, the method of this first embodiment comprises threading the guide bars for stitching with an elastic yarn, and knitting the elastic yarn together by moving the knitting elements to produce a series of stitches forming the knitted fabric. During knitting, the guide bar for stitching that is closest to the needle bar knits a substantial number of pillar stitches. Depending upon the movement of this guide bar, open or closed stitches can be produced. The pillar stitch is preferably a closed pillar stitch. In accordance with this same embodiment, at least one of the other guide bars for stitching performs a substantial number of two needle overlap constructions or knits a substantial number of pillar stitches.

According to another embodiment of the present invention, the wholly elastic warp knitted fabric of the invention is produced by moving the guide bar for stitching closest to the needle bar to perform a substantial number of two needle overlap constructions. In this embodiment, at least one of the other guide bars for stitching knits a substantial number of pillar stitches, preferably closed pillar stitches.

The invention is also directed to wholly elastic warp knitted fabrics comprising an inlaid yarn which is held or trapped into the structure of the knitted fabric. In accordance with the invention, the inlaid yarn may be an elastomeric or non-elastomeric warp yarn, weft insertion yarn or combinations thereof. Laying-in is achieved by means of inlay bars and weft insertion devices during knitting of the elastic fabric. Examples of the inlaid nonelastomeric material include, but are not limited to natural fibers and other synthetic fibers such as aramid, nylon, polyester, polypropylene, acrylic, glass, carbon and metallic fibers or yarns. Natural fibers which are suitable for use in the invention include, but are not limited to cotton, linen, sisal, hemp, wool, silk, kenaf and coconut fiber.

The methods of the invention can be used to produce a textile fabric of any pattern or structure, e.g., a warp knitted fabric with a regular surface or a net structure. Therefore, depending upon the structure and pattern of the fabric to be produced, the guide bars and inlay bars may be threaded in a variety of ways to produce a specific construction and pattern. As such, the guide bars and inlay bars, independent of each other, may be fully threaded or partly threaded. The fabrics produced in accordance with the invention may be used as complete fabrics. Alternatively, the fabrics of the invention may be sown or combined with other fabrics and materials for a particular application.

The wholly elastic warp knitted fabrics of the present invention are uniquely and advantageously run-free. The properties of these fabrics are advantageously enhanced by laying in a warp or weft insertion yarn in the structure of the fabric during knitting of the elastic warp knitted fabric.

DESCRIPTION OF THE PREFERRED EMBODIMENTS

Figure 1A:
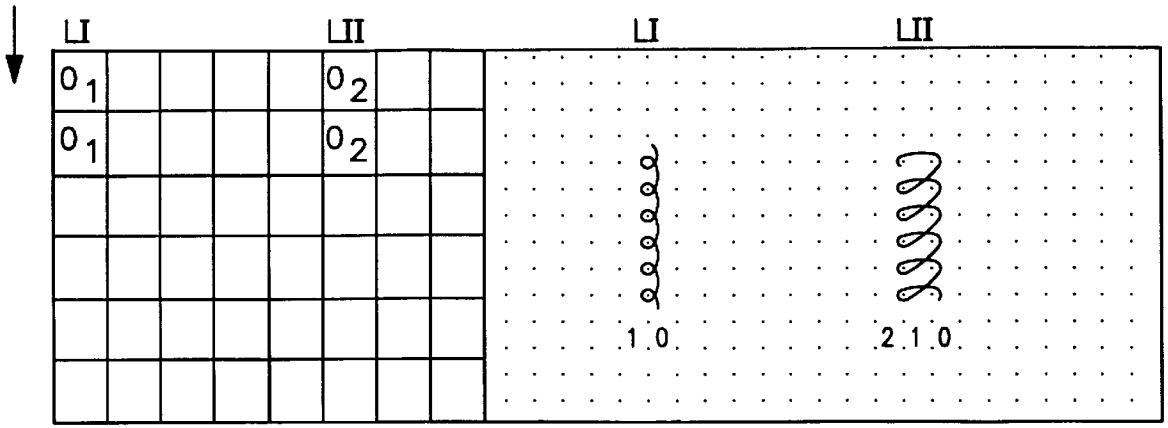
FIGS. 1*a–l* are stitch pattern diagrams for the method and fabrics of the invention when the guide bar for stitching that is closest to the needle bar knits a substantial number of pillar stitches and at least one of the other guide bars for stitching performs a substantial number of two needle overlap constructions.
Figure 1B:
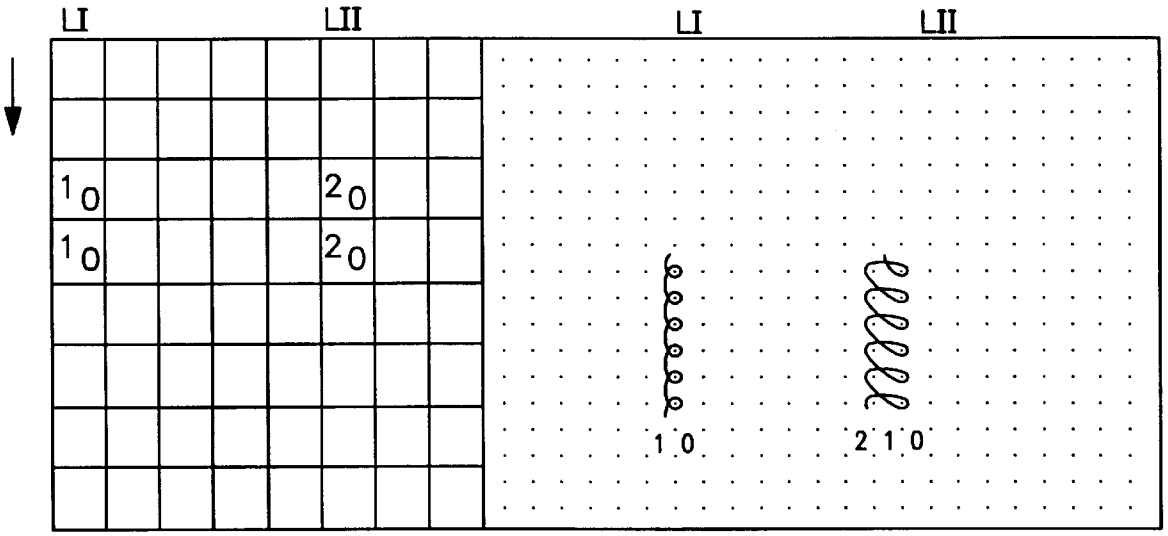
Figure 1C:
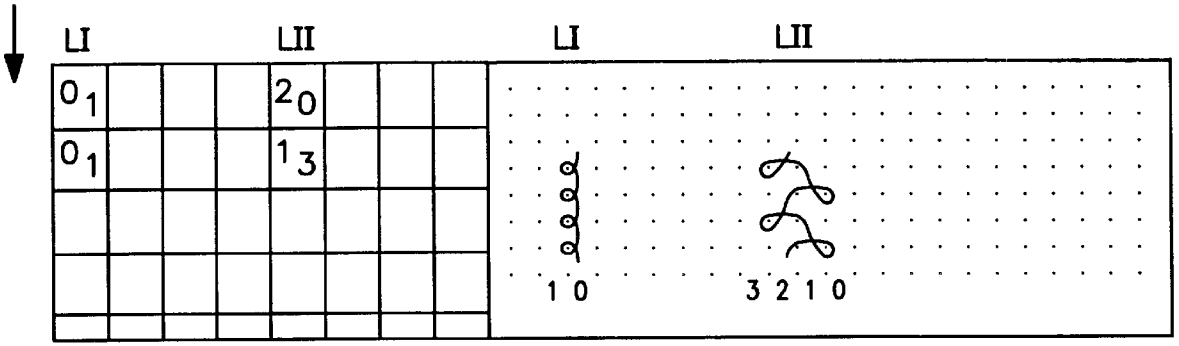
Figure 1D:
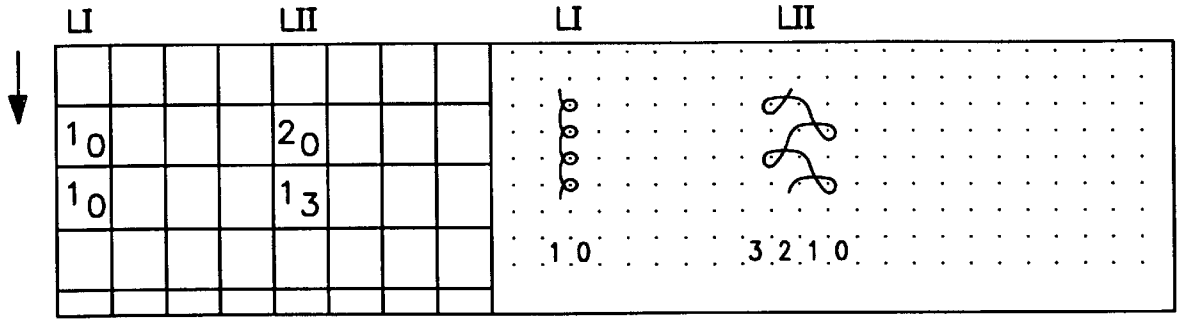
Figure 1E:
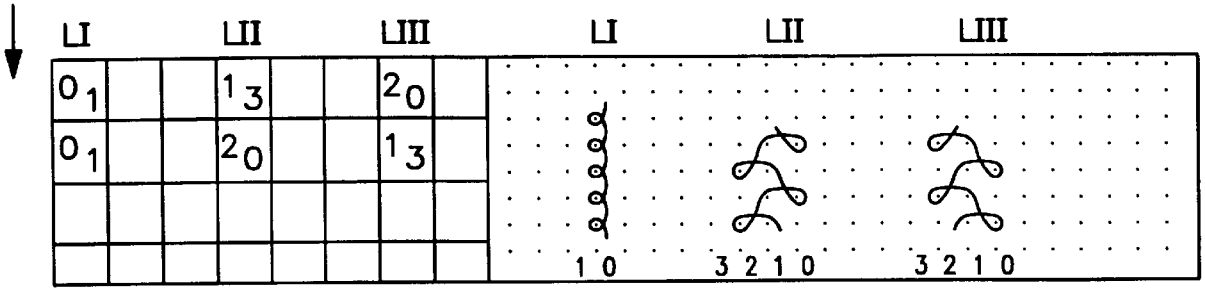

A run-free, wholly elastic fabric in accordance with the invention may be made on any knitting machine that falls under the broad category of warp knitting machines. Examples of conventional warp knitting machines that are used on a commercial scale to produce textile fabrics include the Raschel machine and the Tricot machine. Generally speaking, warp knitting machines with latch needles are classified as Raschel machines and machines with bearded needles are classified as Tricot machines. More recently, however, compound needles are employed in most high-speed warp knitting machines. Warp knitting machines may also be differentiated and classified as single needle bar warp knitting machines and double needle bar warp knitting machines. Any of the Raschel, Tricot, single needle bar and double needle bar warp knitting machines can be used to practice the invention.

The method of the invention is not limited, however, to these specifically named machines but can be used with any knitting machine that produces stitches in accordance with the principles of warp knitting. Moreover, the methods of the present invention are carried out by operating the warp knitting machine in the customary fashion provided that the knitting machine settings of the invention are employed. Accordingly, the machinery and operation of the warp knitting machines as contemplated by the invention are considered to be well within the knowledge and expertise of the person of ordinary skill in the art. Exemplary of the level of ordinary skill in the art pertaining to the invention, and incorporated herein in its entirety by reference, is "An Introduction to the Stitch Formations in Warp Knitting", Copyright 1966 and published by the Employees Association of Karl Mayer e.V.

According to a first embodiment, the knitting elements of the warp knitting machine we include at least one needle bar and at least two guide bars for stitching in varying proximity to the needle bar. The needle bar is provided with knitting needles which may vary in number according to the gauge of the machine, and each guide bar has a number of yarn guides corresponding to the number of needles of the needle bar. The guide bars for stitching are movable in a way that is coordinated with the movement of the needle bar to knit the yarn together to produce a series of stitches.

The guide bars for stitching are threaded with a wholly elastic yarn. Commercially available elastic yarns of a wide range of yarn thickness may be used. DuPont's Lycra® brand fiber is an example of a preferred material for use in the invention. The number of guide bars for stitching and the manner in which these guide bars are threaded is a matter of style and will depend upon the structure and pattern of the elastic fabric to be produced. As such, each of the guide bars is threaded, independently of each other, to be fully threaded or partly threaded. Any combination of fully loaded and partly loaded guide bars is acceptable. With specific regard to partly-threaded guide bars, the guide bar may be loaded with any sequence of empty and full spacing.

The stitch forming elements of the warp knitting machine are operated in a conventional manner to coordinate the movement of the knitting elements to knit the elastic yarn together. As a result of this action, a series or row of stitches are produced to form the elastic knitted fabric. In accordance with the first embodiment, the guide bar for stitching that is closest to the needle bar knits a substantial number of pillar stitches. Depending upon the movement of the guide bar, open or closed stitches can be produced. The pillar stitch is preferably a closed pillar stitch. At least one of the other guide bars for stitching performs a substantial number of two needle overlap constructions or knits a substantial number of pillar stitches.

FIGS. 1*a–l* are stitch pattern drawings of a wholly elastic warp knitted fabric that is made in accordance with the first embodiment of the invention wherein the guide bar for stitching that is closest to the needle bar knits a substantial number of pillar stitches. The guide bar for stitching that is closest to the needle bar is represented by the symbol "LI" and the other guide bars for stitching by "LII" and "LIII". Knitting needle positions for a plurality of successive courses are represented in the diagrams by horizontal lines of dots. The top line represents the course formed immediately after the course represented by the bottom line.

Figure 1F:
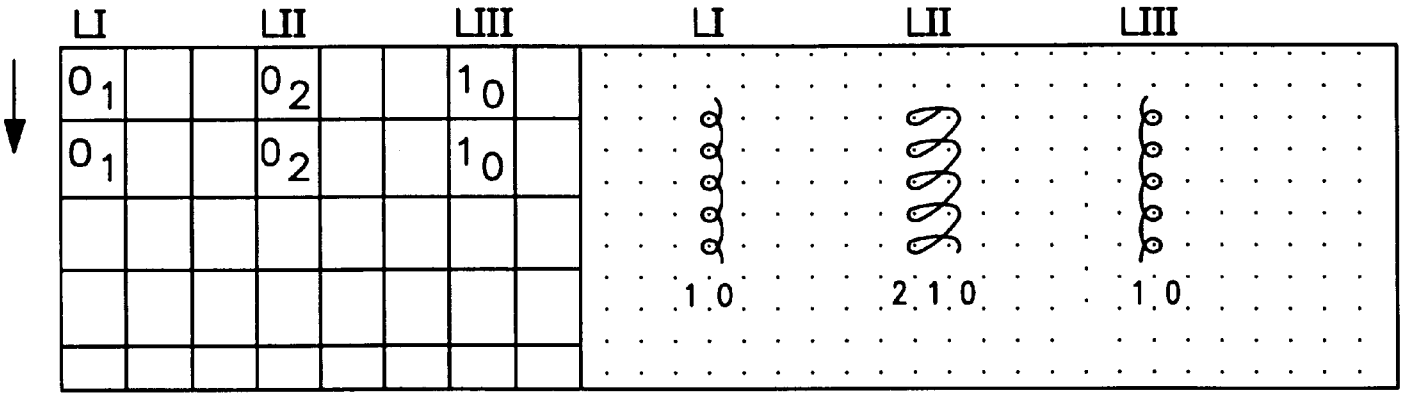
Figure 1G:
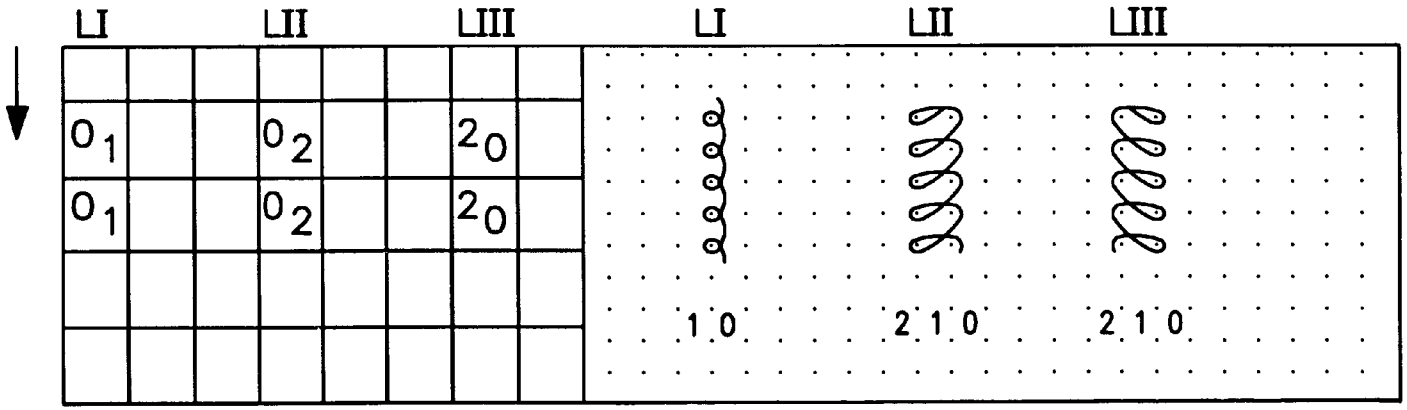
Figure 1H:
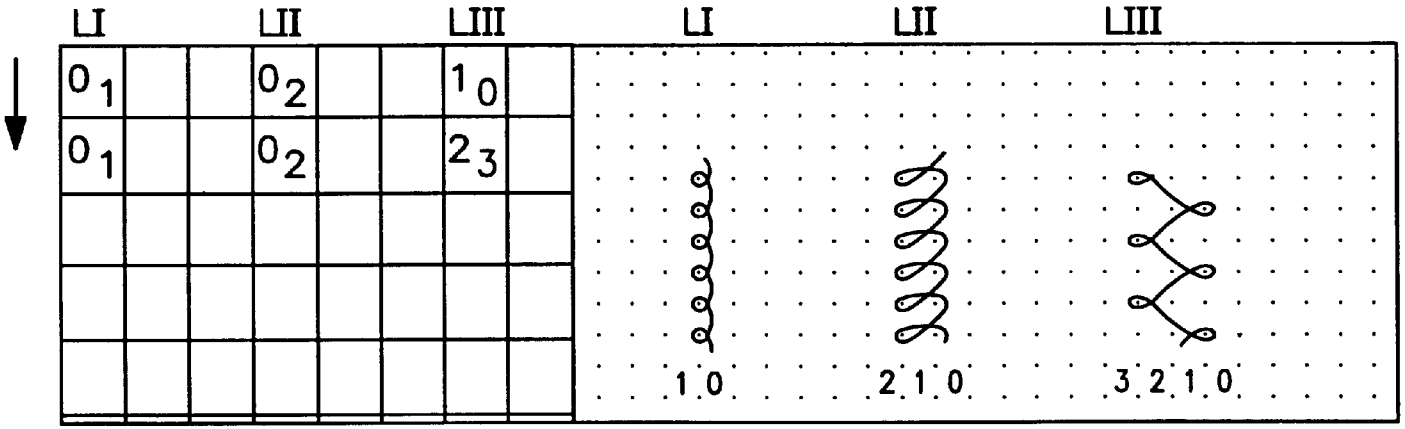
Figure 1I:
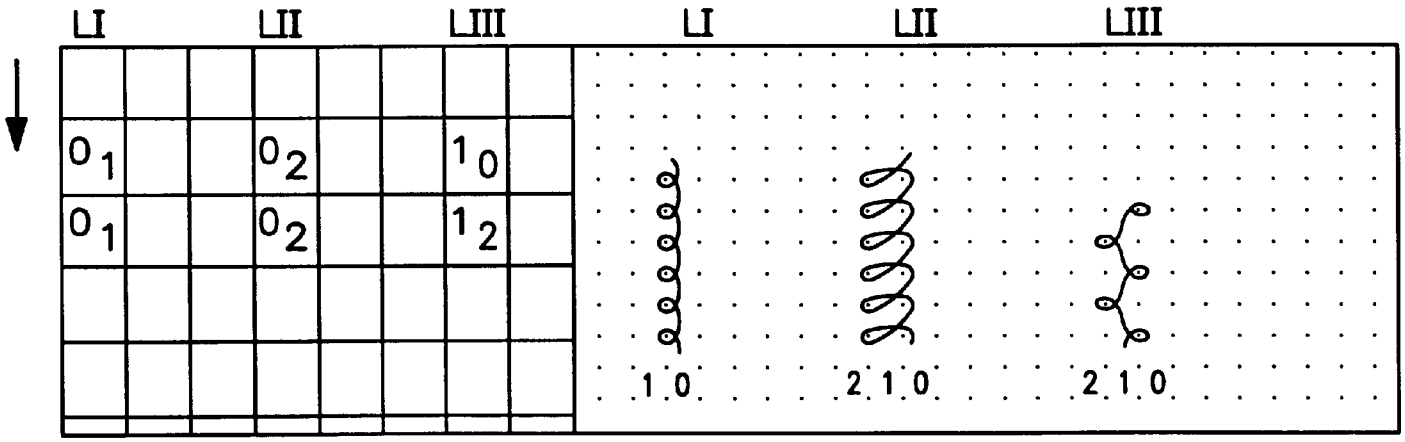
Figure 1J:
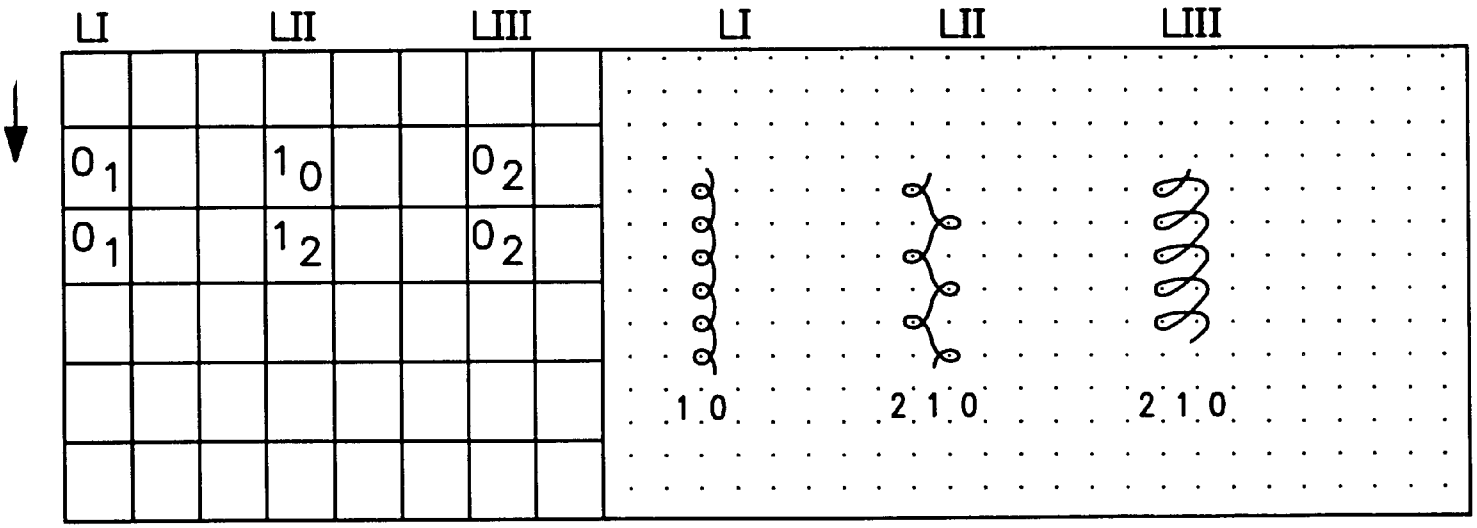
Figure 1K:
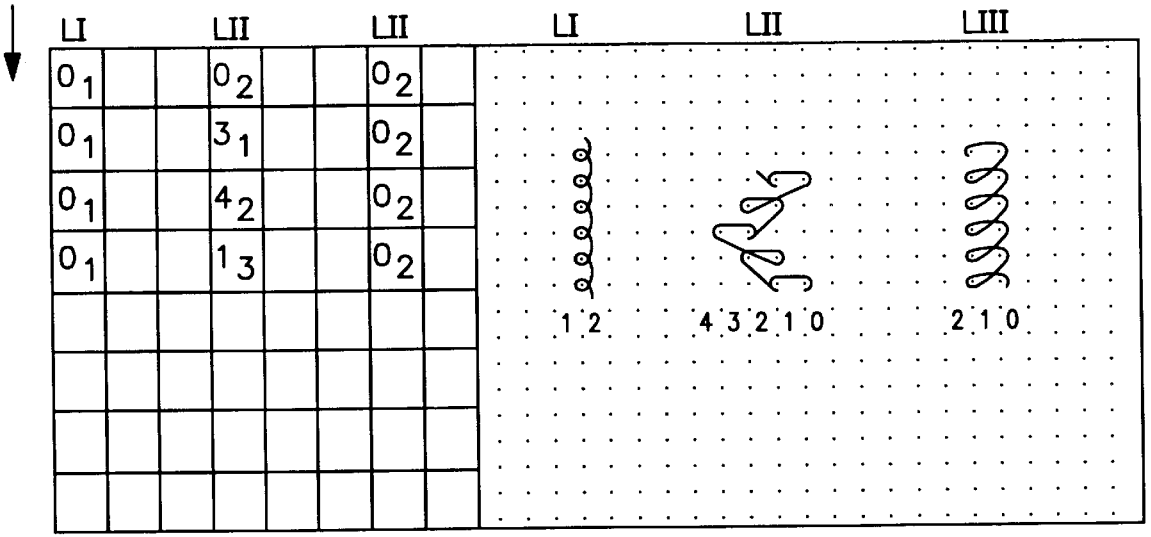
Figure 1L:
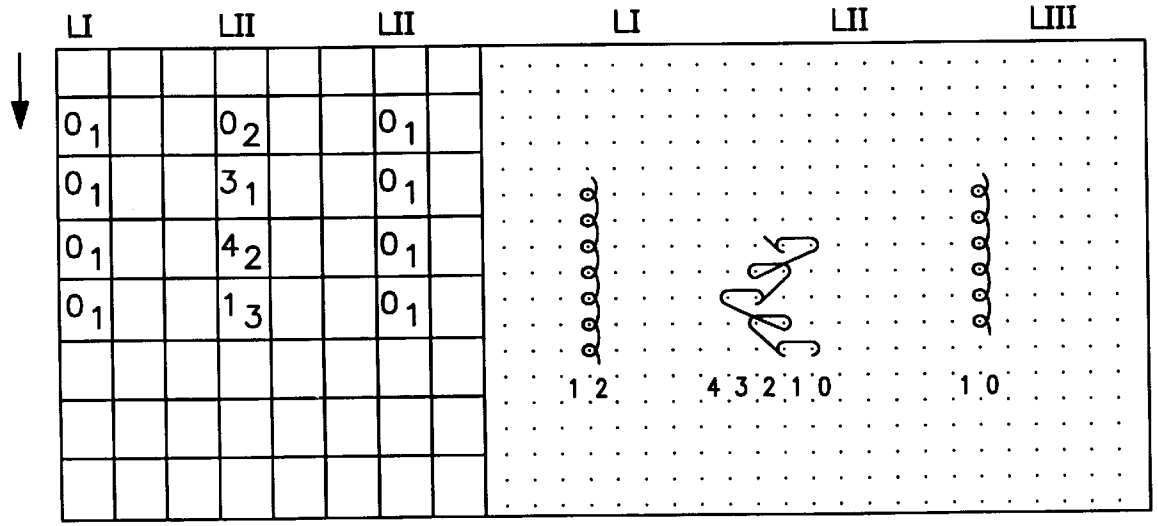

Each of FIGS. 1*a–l* illustrate a stitch pattern wherein at least one of the other guide bars for stitching performs a substantial number of two needle overlap constructions. The patterns of FIGS. 1*a–d* are based on a knitting pattern employing two guide bars whereas FIGS. 1*e–l* demonstrate a multiple guide bar construction. FIGS. 1*f* and 1*l* illustrate a variation where at least one of the other guide bars for stitching performs a substantial number of two needle overlap constructions and at least another guide bar for stitching knits a substantial number of pillar stitches.

In FIG. 1*a*, the stitch construction of the fabric is notationally set out and shows that the "LI" guide bar is moved so that the elastic yarn follows a run denoted by the notation (0-1, 0-1, 0-1, 0-1). The threads of the "LII" bar have movements indicated by the notation (2-0, 2-0, 2-0, 2-0). Similarly, the movement of guide bars through successive courses for FIGS. 1*b–l* is shown in the stitch pattern diagrams as set forth in Table I.

TABLE I

| FIG. | LI guide bar for stitching | LII guide bar for stitching | LIII guide bar for stitching |
|---|---|---|---|
| 1a | 0-1, 0-1, 0-1, 0-1 | 0-2, 0-2, 0-2, 0-2 | |
| 1b | 1-0, 1-0, 1-0, 1-0 | 2-0, 2-0, 2-0, 2-0 | |
| 1c | 0-1, 0-1, 0-1, 0-1 | 2-0, 1-3, 2-0, 1-3 | |
| 1d | 1-0, 1-0, 1-0, 1-0 | 2-0, 1-3, 2-0, 1-3 | |
| 1e | 0-1, 0-1, 0-1, 0-1 | 1-3, 2-0, 1-3, 2-0 | 2-0, 1-3, 2-0, 1-3 |
| 1f | 0-1, 0-1, 0-1, 0-1 | 0-2, 0-2, 0-2, 0-2 | 1-0, 1-0, 1-0, 1-0 |
| 1g | 0-1, 0-1, 0-1, 0-1 | 0-2, 0-2, 0-2, 0-2 | 2-0, 2-0, 2-0, 2-0 |
| 1h | 0-1, 0-1, 0-1, 0-1 | 0-2, 0-2, 0-2, 0-2 | 1-0, 2-3, 1-0, 2-3 |
| 1i | 0-1, 0-1, 0-1, 0-1 | 0-2, 0-2, 0-2, 0-2 | 1-0, 1-2, 1-0, 1-2 |
| 1j | 0-1, 0-1, 0-1, 0-1 | 1-0, 1-2, 1-0, 1-2 | 0-2, 0-2, 0-2, 0-2 |
| 1k | 0-1, 0-1, 0-1, 0-1 | 0-2, 3-1, 4-2, 1-3 | 0-2, 0-2, 0-2, 0-2 |
| 1l | 0-1, 0-1, 0-1, 0-1 | 0-2, 3-1, 4-2, 1-3 | 0-1, 0-1, 0-1, 0-1 |

Figure 2A:
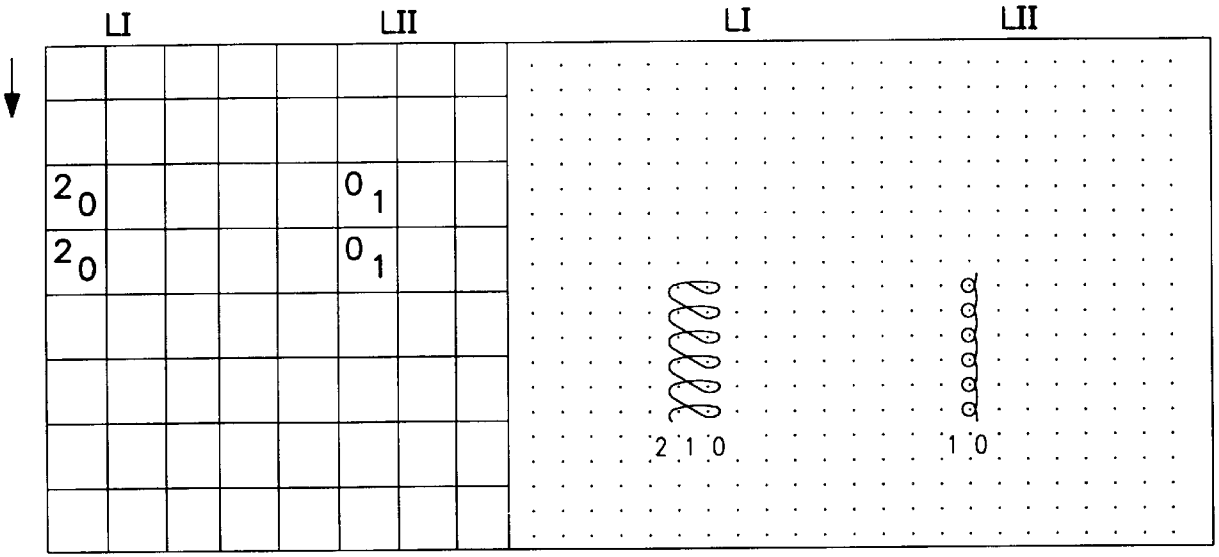
FIGS. 2*a–e* are stitch pattern diagrams for the method and fabrics of the invention when the guide bar for stitching that is closest to the needle bar performs a substantial number of two needle overlap constructions and at least one of the other guide bars for stitching knits a substantial number of pillar stitches.
Figure 2B:
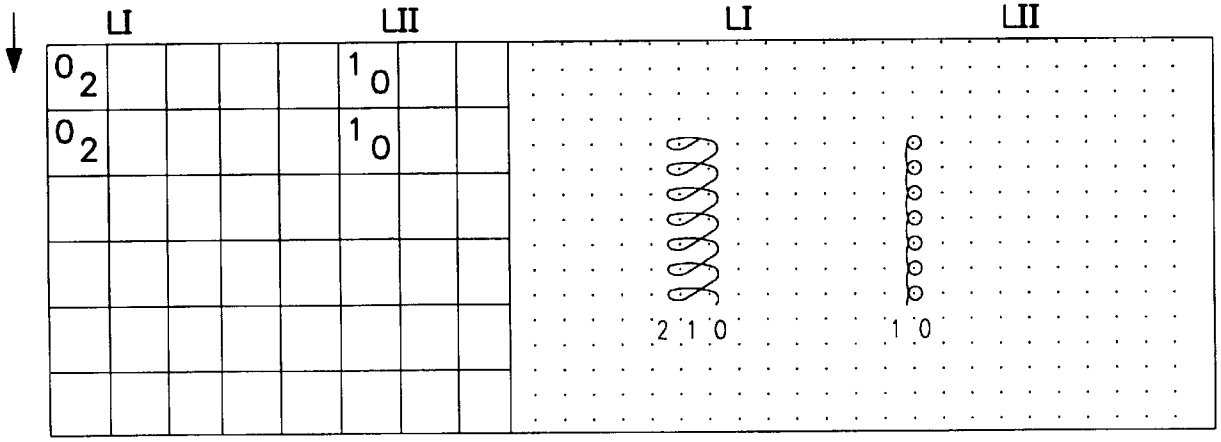
Figure 2C:
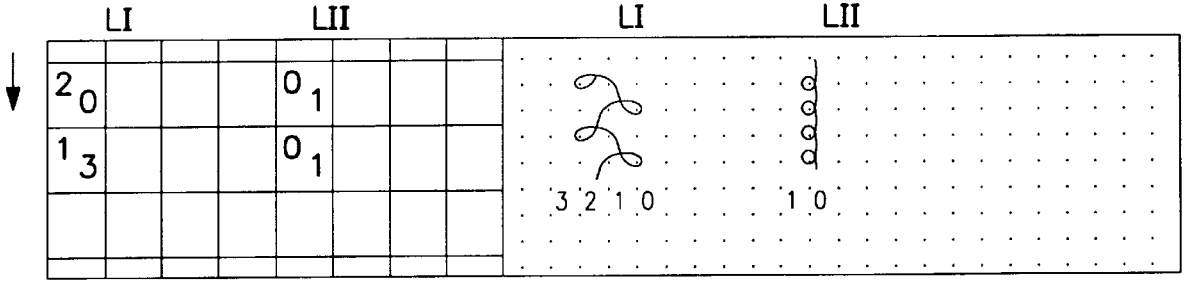
Figure 2D:
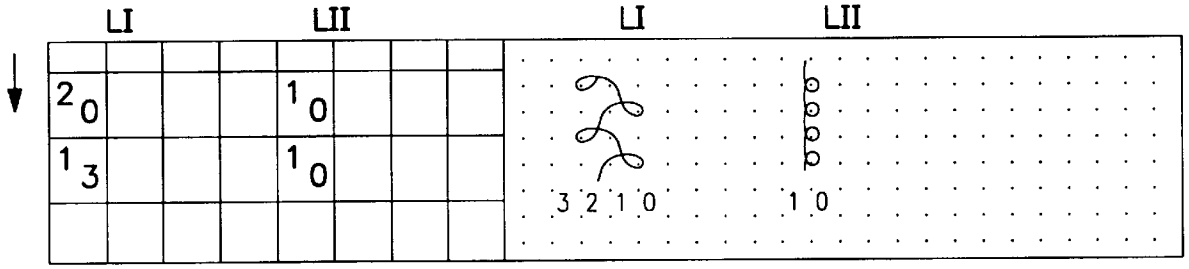
Figure 2E:
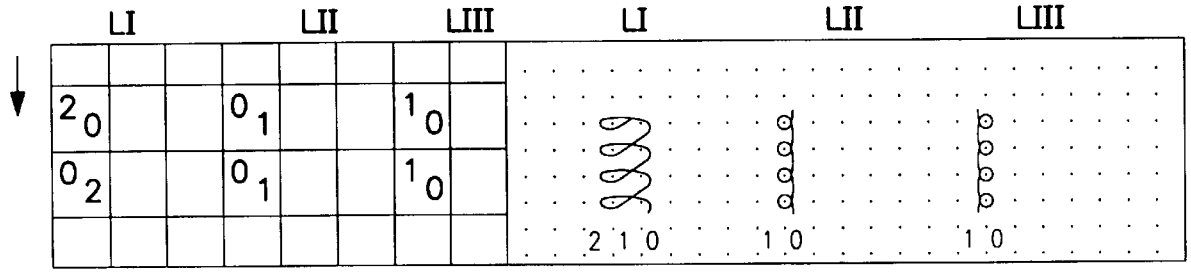

In accordance with another embodiment, the wholly elastic warp knitted fabrics of the invention are prepared by moving the guide bar for stitching that is closest to the needle bar to perform a substantial number of two needle overlap constructions. At least one of the other guide bars for stitching knits a substantial number of pillar stitches, preferably closed pillar stitches. FIGS. 2*a–e* are stitch patterns of a wholly elastic warp knitted fabric that is made in accordance with this embodiment. The patterns of FIGS. 2*a–d* are based on a knitting pattern employing two guide bars for stitching whereas FIG. 2*e* illustrates a multiple guide bar construction. The movement of the guide bars for stitching through successive courses for FIGS. 2*a–e* is shown in the stitch pattern diagrams as set forth in Table II.

TABLE II

| FIG. | LI guide bar for stitching | LII guide bar for stitching | LIII guide bar for stitching |
|---|---|---|---|
| 2a | 2-0, 2-0, 2-0, 2-0 | 0-1, 0-1, 0-1, 0-1 | |
| 2b | 0-2, 0-2, 0-2, 0-2 | 1-0, 1-0, 1-0, 1-0 | |
| 2c | 2-0, 1-3, 2-0, 1-3 | 0-1, 0-1, 0-1, 0-1 | |
| 2d | 2-0, 1-3, 2-0, 1-3 | 1-0, 1-0, 1-0, 1-0 | |
| 2e | 0-2, 0-2, 0-2, 0-2 | 0-1, 0-1, 0-1, 0-1 | 1-0, 1-0, 1-0, 1-0 |

Therefore, as illustrated by FIGS. 1*a–l* and FIGS. 2*a–e*, the present invention enables one to achieve what was previously not possible. By following the methods and knitting machine settings of the invention, it is possible to warp knit elastic fibers by themselves, i.e., without knitting the elastic yarn with a natural or synthetic yarn, to form a stable elastic fabric with a commercially acceptable degree of run-resistance. It is contemplated that these wholly elastic, warp knitted fabrics with high non-run characteristics will be of significant advantage to the growing textile markets including but not limited to the clothing, household and furnishing sectors as well as the automotive, aerospace, sports, medical and building industries. The fabrics produced in accordance with the invention may be used as complete fabrics. Alternatively, the fabrics of the invention may be sown or combined with other fabrics and materials for a particular application, a garment comprising alternating rows of the claimed fabric and another material.

Additionally, the appearance, surface and properties of the warp knitted elastic fabrics of the invention can be altered for any suitable purpose or desired application by laying-in an elastomeric or non-elastomeric yarn. The inlaid yarn is actually tied in or trapped into the fabric formed by the stitches of elastic yarn. Examples of an inlaid non-elastomeric material that are suitable for use in the invention include, but are not limited to natural fibers and other synthetic fibers such as aramid, nylon, polyester, polypropylene, acrylic, glass, carbon and metallic fibers or yarns. Examples of the natural fibers include, but are not limited to cotton, linen, sisal, hemp, wool, silk, fenas and coconut fiber.

Laying-in is achieved by any of the art recognized warp inlay and weft insertion techniques and is well within the level of ordinary skill. For example, the warp knitting machine as contemplated by the invention may further comprise one or more inlay bars or weft insertion devices. As such, there is no limitation as to the manner in which the inlaid yarn may be introduced into the elastic fabric so long as the elastic yarn is knitted to form the fabric in accordance with the methods of the invention. As with the guide bars for stitching, the inlay guide bar may be fully or partially threaded. The design or properties of the fabric will determine the extent to which the guide bars for stitching and inlay guide bars are threaded. Similarly, it is possible to prepare the elastic warp knitted fabrics comprising a combination of warp inlay and weft insertion.

Figure 3A:
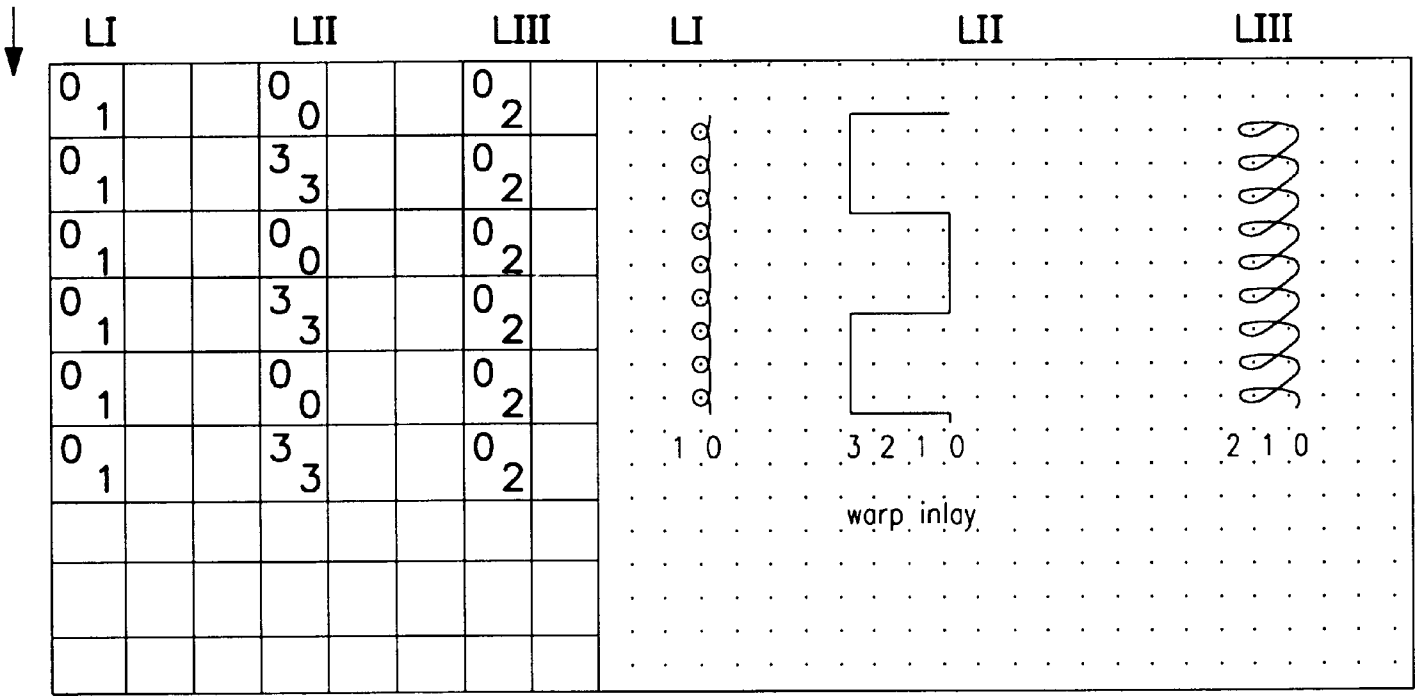
FIGS. 3*a–b* illustrate the knit construction details for a warp inlay in accordance with the invention.
Figure 3B:
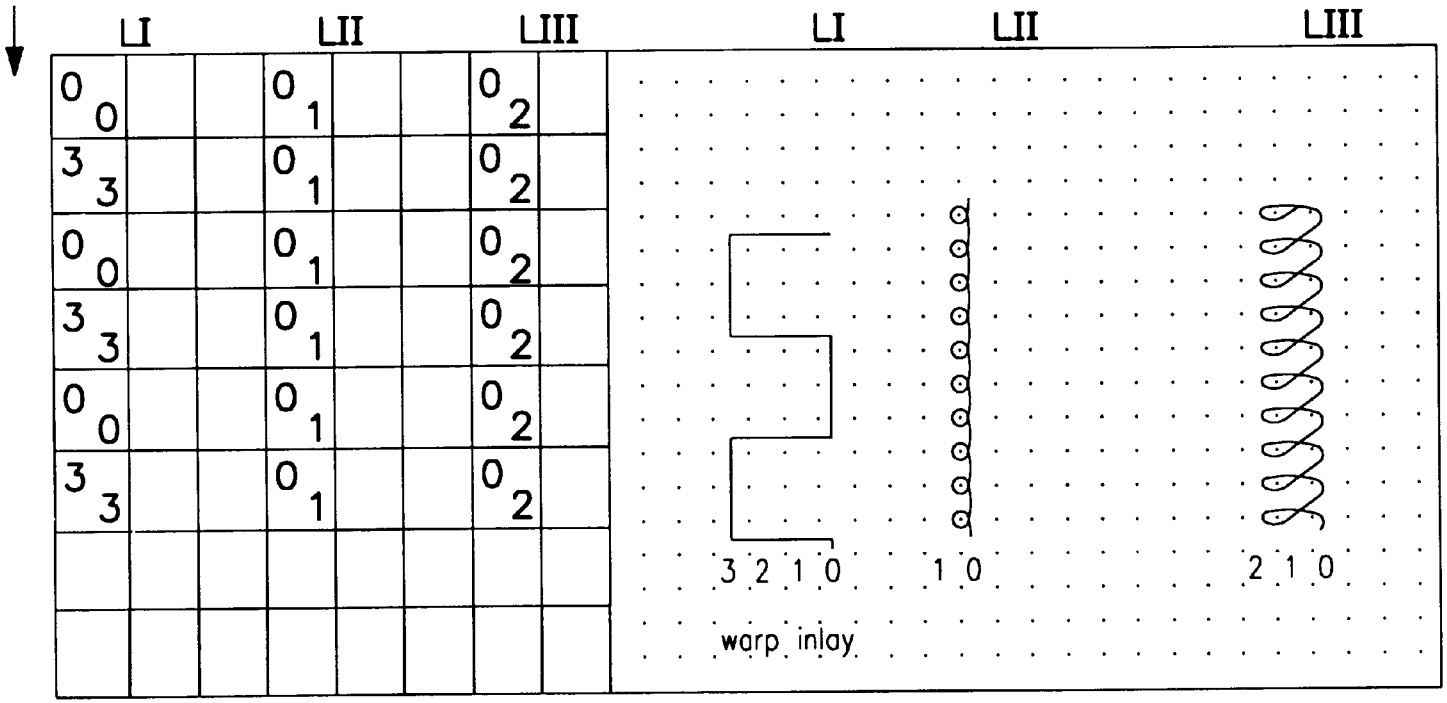

FIGS. 3*a–b* illustrate a multiple bar construction for a warp inlay. The guide bars for stitching and the inlay bar are moved alternately to lay-in the inlaid yarn in the stitches made by the guide bars to form the elastic fabric having a warp inlay. In each of FIGS. 3*a–b*, the guide bar for stitching that is closest to the needle bar knits a substantial number of pillar stitches and the other guide bar performs a two needle overlap construction. In FIG. 3*a*, the guide bar for stitching that is closest to the needle bar is designated as "LI" whereas the inlay guide bar is designated as "LII". The other guide bar for stitching is designated as "LIII". In FIG. 3*b*, the inlay guide bar is denoted by the symbol "LI". The guide bar for stitching that is closest to the needle bar is designated as "LII" and the other guide bar for stitching as "LIII". The movement of the guide bars for stitching and inlay bar through successive courses for FIGS. 3*a–b* is shown in the stitch pattern diagrams as set forth in Table III.

TABLE III

| FIG. | LI guide bar for stitching | LII inlay bar | LIII guide bar for stitching |
|---|---|---|---|
| 3a | 0-1, 0-1, 0-1, 0-1 | 0-0, 3-3, 0-0, 3-3 | 0-2, 0-2, 0-2, 0-2 |
| | LI inlay bar | LII guide bar for stitching | LIII guide bar for stitching |
| 3b | 0-0, 3-3, 0-0, 3-3 | 0-1, 0-1, 0-1, 0-1 | 0-2, 0-2, 0-2, 0-2 |

Figure 4:
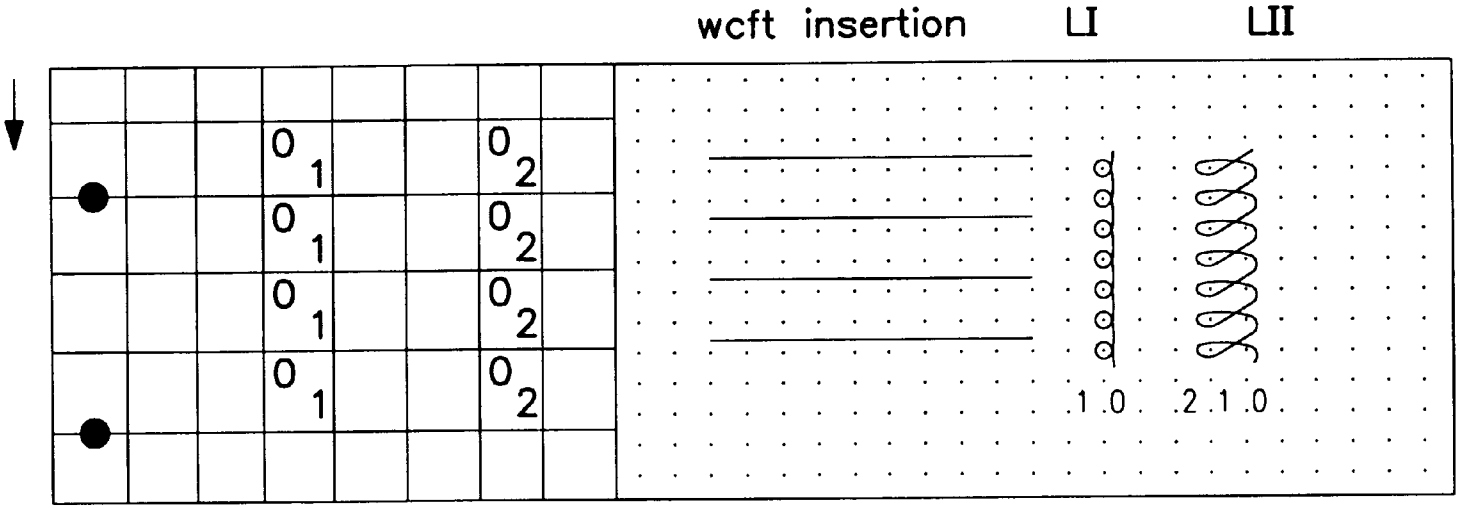
FIG. 4 illustrates the knit construction details for a weft inserted inlay in accordance with the invention.

FIG. 4 illustrates the details of a two bar construction for a weft inserted inlay in accordance with the invention. The guide bar for stitching closest to the needle bar is denoted as "LI" and the other guide bar as "LII". In accordance with FIG. 4, LI knits a closed pillar stitch and LII performs a two needle overlap construction. The movement of the weft insertion device and the guide bars for stitching through successive courses for FIG. 4 is shown in the stitch pattern diagrams as set forth in Table IV.

TABLE IV

| FIG. | weft insertion | LI guide bar for stitching | LII guide bar for stitching |
|---|---|---|---|
| 4 | — | 0-1, 0-1, 0-1, 0-1 | 0-2, 0-2, 0-2, 0-2 |

Figure 5:
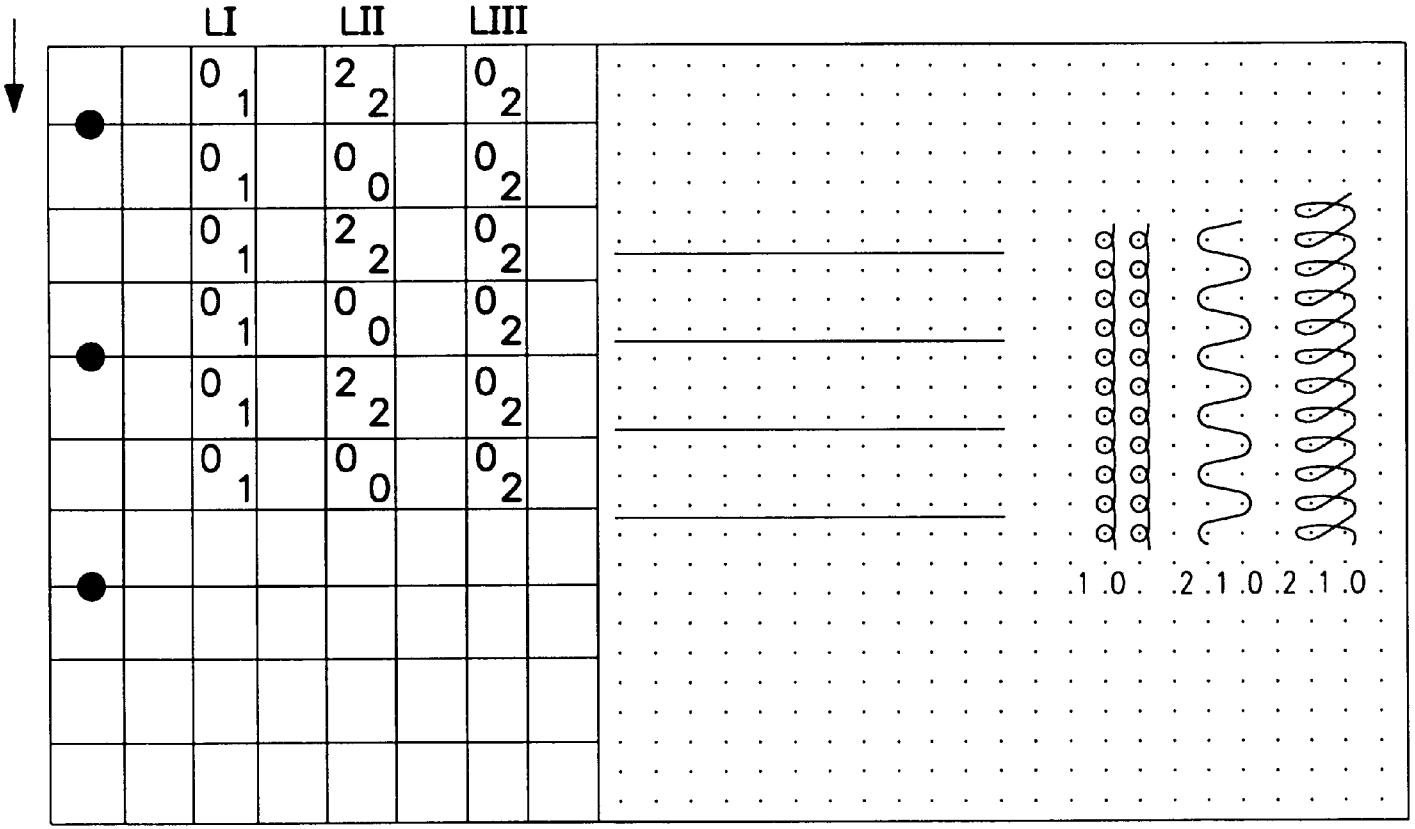
FIG. 5 illustrate the knit construction details of a combination of warp and weft insertion inlays in accordance with the invention.

FIG. 5 illustrates the knit construction details of a combination of warp and weft insertion inlays. As such, a weft insertion device and a warp inlay bar are used. In FIG. 5, the guide bar for stitching that is closest to the needle bar is designated as "LI" and the other guide bar for stitching as "LIII". The inlay guide bar is denoted as "LII". The movement of the guide bars for stitching, inlay bar and weft insertion device through successive courses for FIG. 5 is shown in the stitch pattern diagrams as set forth in Table V.

TABLE V

| FIG. | weft insertion | LI guide bar for stitching | LII warp inlay | LIII guide bar for stitching |
|---|---|---|---|---|
| 5 | — | 0-1, 0-1, 0-1, 0-1 | 2-2, 0-0, 2-2, 0-0 | 0-2, 0-2, 0-2, 0-2 |

EXAMPLES

A. Flat Fabrics

A Karl Mayer KE 3 warp knitting machine was employed to produce the fabrics as identified in FIGS. 1*a–l* and FIGS. 2-*a–e*. The guide bars for stitching were fully loaded with 44 dtex Lycra® type 269B elastic yarn. The needle spacing was 28 needles per inch. Separate trials using the machine settings of FIGS, 1*a–l* and FIGS. 2*a–e* were used. The knitting machine was operated in the conventional method. The resulting flat fabrics did not run or disintegrate when punctured.

B. Net Structure

Figure 6A:
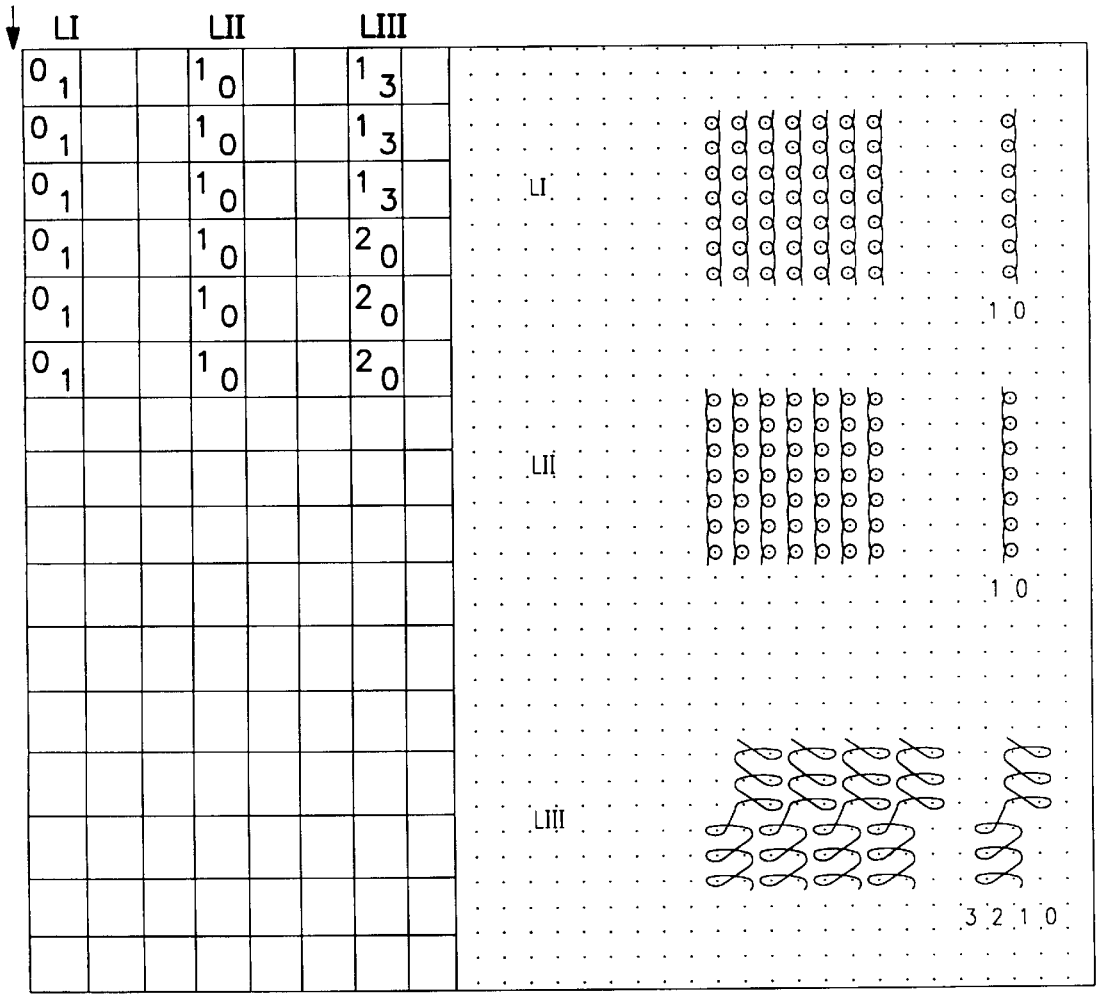
FIGS. 6*a–b* are stitch pattern diagrams of a net construction prepared in accordance with the method of the invention.
Figure 6B:
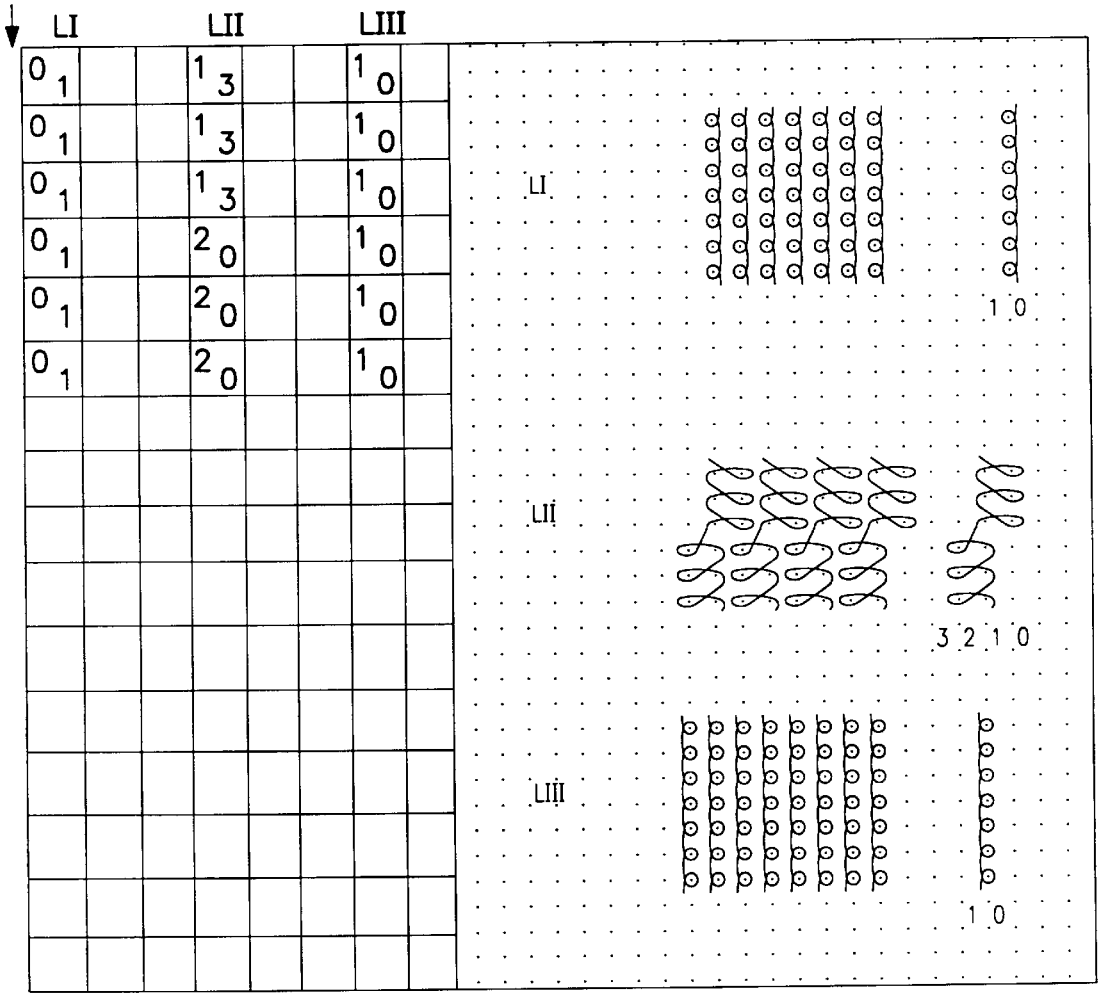

A Karl Mayer KE 3 warp knitting machine with three guide bars was employed to manufacture a net structure. FIGS. 6*a–b* are stitch pattern diagrams of a multiple bar, net construction prepared in accordance with the method of the invention. The guide bars for stitching were loaded with Lycra® type 269B elastic yarn in the full and empty sequences as shown in the figures. In each of FIGS. 6*a–b*, the guide bar closest to the needle bar is designated as "LII" and the other guide bars for stitching as "LII" and "LIII". With regard to FIG. 6*a*, guide bars LI and LII knit a closed pillar stitch whereas guide bar LIII performs a two needle overlap construction. In FIG. 6*b*, guide bars LI and LIII knit a closed pillar stitch and guide bar LII performs a two needle overlap construction. The guide bar closest to the needle bar is designated as "LI" and the other guide bars for stitching as "LII" and "LIII". Guide bars LI and LII knit a closed pillar stitch whereas guide bar LIII performs a two needle overlap construction. The movement of the guide bars for stitching through successive courses for FIGS. 6*a–b* is shown in the stitch pattern diagrams as set forth in Table VI.

TABLE VI

| FIG. | LI guide bar for stitching | LII guide bar for stitching | LIII guide bar for stitching |
|---|---|---|---|
| 6a | 0-1, 0-1, 0-1, 0-1, 0-1, 0-1 | 1-0, 1-0, 1-0, 1-0, 1-0, 1-0 | 1-3, 1-3, 1-3, 2-0, 2-0, 2-0 |
| 6b | 0-1, 0-1, 0-1, 0-1, 0-1, 0-1 | 1-3, 1-3, 1-3, 2-0, 2-0, 2-0 | 1-0, 1-0, 1-0, 1-0, 1-0, 1-0 |

The knitting machine was operated in the conventional method and the resulting net type fabric did not run or disintegrate when punctured. It should be noted that it is possible to produce net structures in accordance with the invention with knitting constructions employing two or more guide bars.

The invention represents a significant advancement in the textile art. It was previously not known how to knit elastic fibers to prepare run-free, wholly elastic fabrics. As such, the method of the invention solves a long standing problem. By teaching the knitting machine settings as disclosed herein, it is now possible to knit, for example, 100% Lycra® type textiles which do not run. Because of their uniqueness and heretofore unexplored fields of use, the new textiles of the invention are sure to come to the forefront of the textile industry. This is especially true of the fabrics of the invention which also comprise a non-elastomeric inlaid yarn. Advantageously, the properties of this new type of composite warp knitted fabric are ideal for applications in the industrial textiles market which require high performance materials.

It is to be understood that the present invention is not limited to the embodiments described above, but encompass any and all embodiments within the scope of the following claims.

I claim:

1. A method of making a warp knitted elastomeric fabric on a warp knitting machine comprising knitting elements including a needle bar and at least two guide bars for stitching in varying proximity to the needle bar, the method comprising:

threading the guide bars with an elastomeric yarn, and knitting the elastomeric yarn together by moving the knitting elements to produce a series of warp-knit stitches forming the basic knitted fabric essentially free of any non-elastomeric yarn, wherein, a single needle bar is used to knit the fabric and, during knitting, the guide bar closest to needle bar knits a substantial number of pillar stitches.

2. The method according to claim 1, wherein at least one of the other guide bars performs a substantial number of two needle overlap constructions.

3. The method according to claim 1, wherein at least one of the other guide bars knits a substantial number of pillar stitches.

4. The method according to claim 1, wherein the pillar stitch is a closed stitch.

5. A method of making a warp knitted elastomeric fabric on a warp knitting machine comprising knitting elements including a needle bar and at least two guide bars for stitching in varying proximity to the needle bar, the method comprising:

threading the guide bars with an elastomeric yarn, and knitting the elastomeric yarn together by moving the knitting elements to produce a series of warp-knit stitches forming the basic knitted fabric essentially free of any non-elastomeric yarn, wherein, a single needle bar is used to knit the fabric and, during knitting, the guide bar closest to the needle bar performs a substantial number of two needle overlap constructions, and at least one of the other guide bars knits a substantial number of pillar stitches.

6. The method according to claim 5, wherein the pillar stitch is a closed stitch.

7. The method according to claim 1 or 5, wherein the warp knitting machine is a Raschel type machine.

8. The method according to claim 1 or 5, wherein the warp knitting machine is a Tricot type machine.

9. The method according to claim 1 or 5, wherein each of the guide bars are, independently of the other, fully or partially threaded.

10. The method according to claim 1 or 5, wherein the elastomeric yarn is spandex.

11. The method according to claim 1 or 5, further comprising the step of laying-in an elastomeric or non-elastomeric warp yarn in the fabric during knitting.

12. The method according to claim 11, wherein the non-elastomeric yarn is selected from the group consisting of natural fibers, aramid, nylon, polyester, polypropylene, acrylic, glass, carbon and metallic fibers or yarns.

13. The method according to claim 12, wherein the natural fiber is selected from the group consisting of cotton, linen, sisal, hemp, wool, silk, kenaf and coconut fibers.

14. The method according to claim 1 or 5, further comprising the step of laying-in an elastomeric or non-elastomeric weft insertion yarn in the fabric during knitting.

15. The method according to claim 14, wherein the non-elastomeric yarn is selected from the group consisting of natural fibers, aramid, nylon, polyester, polypropylene, acrylic, glass, carbon and metallic fibers or yarns.

16. The method according to claim 15, wherein the natural fiber is selected from the group consisting of cotton, linen, sisal, hemp, wool, silk, kenaf and coconut fiber.

17. The method according to claim 1 or 5, further comprising the steps of laying-in a warp yarn and laying in a weft insertion yarn in the fabric during knitting.

18. The method according to claim 17, wherein the yarn is elastomeric or non-elastomeric.

19. The method according to claim 18, wherein the non-elastomeric yarn is selected from the group consisting of natural fibers, aramid, nylon, polyester, polypropylene, acrylic, glass, carbon and metallic fibers or yarns.

20. The method according to claim 19, wherein the natural fiber is selected from the ax group consisting of cotton, linen, sisal, hemp, wool, silk, kenaf and coconut fiber.

21. A warp knitted elastomeric fabric made by the method of any one of claim 1–4.

22. A warp knitted elastomeric fabric made by the method of any one of claim 5 or 6.

23. A warp knitted elastomeric fabric made by the method of claim 11.

24. A warp knitted elastomeric fabric made by the method of claim 14.

25. A warp knitted elastomeric fabric made by the method of claim 17.

26. A warp knitted elastomeric fabric essentially free of any non-elastomeric yarn.

27. A warp knitted elastomeric fabric comprising a warp inlaid yarn selected from the group consisting of elastomeric yarns, non-elastomeric yarns and mixtures thereof, in which the basic fabric is essentially free of any non-elastomeric yarn.

28. A warp knitted elastomeric fabric comprising a weft insertion yarn selected from the group consisting of elastomeric yarns, non-elastomeric yarns and mixtures thereof, in which the basic fabric is essentially free of any non-elastomeric yarn..

29. A warp knitted elastomeric fabric comprising a warp inlaid yarn and a weft insertion yarn, wherein the warp inlaid yarn and weft insertion yarn are selected from the group consisting of elastomeric yarns, non-elastomeric yarns and mixtures thereof, in which the basic fabric is essentially free of any non-elastomeric yarn.

* * * * *

UNITED STATES PATENT AND TRADEMARK OFFICE

CERTIFICATE OF CORRECTION

PATENT NO. : 6,446,471 B1
DATED : September 10, 2002
INVENTOR(S) : Kaplancali

It is certified that error appears in the above-identified patent and that said Letters Patent is hereby corrected as shown below:

Column 10,
Lines 21-22, cancel claim 26.

Signed and Sealed this

Fourteenth Day of January, 2003

JAMES E. ROGAN
*Director of the United States Patent and Trademark Office*